US005455614A

United States Patent [19]

Rhodes

[11] Patent Number: 5,455,614

[45] Date of Patent: Oct. 3, 1995

[54] PRINTING METHOD AND PRINT HEAD HAVING ANGLED INK JET

[75] Inventor: Paul M. Rhodes, Cambridgeshire, United Kingdom

[73] Assignee: Linx Printing Technologies Limited, United Kingdom

[21] Appl. No.: 940,667

[22] Filed: Sep. 4, 1992

[30] Foreign Application Priority Data

Sep. 6, 1991 [GB] United Kingdom ..... 9119140

[51] Int. Cl.[6] ..... B41J 2/02

[52] U.S. Cl. ..... 347/74; 347/77

[58] Field of Search ..... 347/74, 76, 77, 347/49

[56] References Cited

U.S. PATENT DOCUMENTS

| | | | |
|---|---|---|---|
| 3,798,656 | 3/1974 | Lowy et al. | 347/77 |
| 3,813,676 | 5/1974 | Wolfe | 347/76 |
| 4,219,823 | 8/1980 | Fathergill et al. | 347/77 |
| 4,314,258 | 2/1982 | Donahue et al. | 347/77 |
| 4,550,322 | 10/1985 | Tamai | 347/74 X |

FOREIGN PATENT DOCUMENTS

| | | |
|---|---|---|
| 58-171969 | 10/1983 | Japan . |
| 1278296 | 6/1972 | United Kingdom . |
| 1590040 | 5/1981 | United Kingdom . |
| 2139962 | 11/1984 | United Kingdom . |

OTHER PUBLICATIONS

Gamblin et al., "Orthogonalization of Electrostatic Printing," IBM Technical Disclosure Bulletin, vol. 11, No. 10, Mar. 1969, pp. 1292–1293.

Patent Abstracts of Japan, vol. 8, No. 9, Jan. 14, 1984, Hitachi Seisakusho.

Patent Abstracts of Japan, vol. 10, No. 307, Oct. 18, 1986, Ricoh Co. Ltd.

Patent Abstracts of Japan, vol. 10, No. 326, Nov. 6, 1986, Fuji Xerox Co.

European Search Report

"Enhanced Aerodynamic Compensation With Tilted Deflection Electrodes", *IBM Technical Disclosure Bulletin*, vol. 23, No. 7A, Dec. 1980 pp. 2711–2712.

*Primary Examiner*—William J. Royer

*Attorney, Agent, or Firm*—Lerner, David, Littenberg, Krumholz & Mentlik

[57] ABSTRACT

In a continuous ink jet printer of the type in which drops can be deflected to a plurality of print positions, the path of undeflected drops is angled relative to the substrate 23 which is printed onto, so as to shorten the path of the most deflected drops. Since the most deflected drops are the least stable, this tends to increase print quality or allow greater printing speed. The plane of deflection of ink drops may be parallel to a circuit board 1 on which components of the print head are mounted, enabling a deflection electrode 15 and other electrodes to be formed directly on the circuit board, thereby reducing the number of components which have to be mounted separately onto the circuit board 1.

13 Claims, 10 Drawing Sheets

PRINTING METHOD AND PRINT HEAD HAVING ANGLED INK JET

The present invention relates to ink jet printers. It has particular application to printers in which drops of ink are deflected, e.g electrostatically, to chosen print positions. Typically, the printer is a continuous ink jet printer.

Continuous ink jet printers are known from, for example, WO-A-89/03768 (and U.S. patent application Ser. No. 07/469496), EP-A-0424608 (and U.S. patent application Ser. No. 07/591286), and UK patent application 9025273.5 published as GB-A-2249995 (and U.S. patent application Ser. No. 07/794113), all of which are incorporated herein by reference.

In such known ink jet printers a continuous jet of ink is modulated so as to separate into drops while passing a charge electrode, so that each individual drop is charged to a level determined by the voltage on the charge electrode. The drops then pass between deflection plates having different electric potentials, so that there is an electric field therebetween. The electric field deflects the drops to an extent dependent on the charge on each individual drop. In this way, drops of ink can be directed to chosen printing positions by appropriate selection of the charge on the drop. If it is desired that a drop should not be printed, it is directed to a gutter which catches the drop. Ink from the gutter is typically recirculated back into the ink supply for the ink gun from which the jet issues.

In a typical arrangement, the gutter is positioned so that uncharged (and therefore undeflected) drops pass to it, and drops must be charged (and therefore deflected) in order to be printed. In such an arrangement, the ink gun, charge and deflection electrodes, the gutter and other associated parts are normally provided in a longitudinally extending print head, such that the stream of ink passing from the ink gun to the gutter is parallel to the axis of the print head, and the axis is arranged substantially at right angles to the substrate to be printed onto. Thus, of the drops which are printed on the substrate, those with the minimum charge and the least amount of deflection (just sufficient to miss the gutter) strike the substrate at an angle close to right angles, whereas the most highly charged and most deflected drops strike the substrate at a more slanting angle. The present inventor has realised that such an arrangement is not always ideal, for example for the following reasons.

The stream of drops passing from the ink jet to the gutter tends to create a corresponding flow of air along the ink jet path to the gutter. Consequently, drops travelling along the path from the ink gun to the gutter experience reduced aerodynamic drag. The greater the angle of deflection of the drop away from the path to the gutter, the further it has to go into still air away from the stream of moving air and therefore the greater its susceptibility to aerodynamic drag and associated effects.

Also, the ink jet printer is normally arranged so that uncharged drops pass to the gutter, and the greater the angle away from the gutter the greater the level of charge on a drop and the more it has to be deflected. The most charged, most deflected drops tend to be the least stable for several reasons. The greater charge means that they are more susceptible to the effects of electrostatic interaction between successive drops. The susceptibility of highly charged drops to electrostatic effects from adjacent drops is normally reduced by inserting one or more guard drops between successive drops to be printed. Guard drops are uncharged drops which pass to the gutter and serve to space apart successive charged drops. Since guard drops are not printed, they reduce the speed at which the printer can print. Typically, the greater the charge of a drop to be printed the greater the need for guard drops to be provided before and/or after it.

Further, there tends always to be some residual error in the voltage placed on a charge electrode, and therefore a residual error in the charge on each drop. This may arise, for example, because the system for setting the voltage for the charge electrode can do so only to a certain resolution, so that the correct voltage can be applied only to the limit of accuracy permitted by that resolution. In the arrangement in which undeflected drops pass to the gutter, the most highly charged drops pass most quickly out of the entrained air flow near the path to the gutter, and therefore experience more aerodynamic drag. This drag slows them down, so that they spend more time in the deflection field, with the consequence that they are deflected to a greater extent than would be expected on the basis of their degree of charge alone. Accordingly, a given level of charge error, arising for example from the limit of resolution of the charge electrode voltage control, results in a greater amount of error in the degree of deflection of a highly charged drop, and consequently a greater amount of error in the position on the substrate at which the drop prints.

In the prior art geometry referred to above, the least stable drops, that is to say the drops with the greatest amount of charge and the greatest path spacing from the path to the gutter, are the drops with the longest path from the ink gun to the substrate, in view of the oblique angle at which they approach the substrate. Consequently, the speed and quality of printing tends to be limited by the characteristics of these drops.

An ink jet printer is known from GB-A-2139962 in which ink drops are deflected to be printed, and undeflected drops pass to a gutter. It appears that all deflected drops are deflected by the same amount so as to follow the same path. This path strikes the surface to be printed onto obliquely. Since only one path is shown for drops to be printed, the consequences of different angles and flight path lengths for different drops does not arise.

A system is known from GB-A-1590040 in which drops are charged to various levels to print at different positions. In one embodiment, the print head is angled relative to the surface being printed onto, in such a manner that the least deflected drops have the shortest flight path.

GB-A-1278296 discloses a system in which undeflected drops are printed and drops which are not to be printed are deflected into a gutter. The undeflected drops strike the surface to be printed onto at an angle. Since only undeflected drops are printed, and all printed drops appear to follow the same path, the consequences of deflecting different drops into different paths for printing do not arise.

U.S. Pat. No. 4,314,258 discloses in FIG. 1 thereof a system in which an ink jet is emitted towards a deflection electrode to which ink drops can be attracted to a varying extent. The electrode is angled relative to the direction of emission of the ink jet, which appears necessary to cause varying degrees of attraction to the electrode to result in varying degrees of deflection of the ink drops. The electrode is placed behind the surface being printed onto, which extends generally parallel to the deflection electrode. Consequently, the ink drops arrive at the substrate obliquely, with the most deflected drops having the shortest path. This geometry is very different from an arrangement in which a deflection field is provided generally at right angles to the direction of travel of undeflected drops, and it does not appear that the teaching of this prior art document can easily be applied to such a system.

U.S. Pat. No. 3,798,656 shows a system in which uncharged drops are angled relative to deflection electrodes, so as to strike gutters formed in the deflection electrodes.

IBM Technical Disclosure Bulletin volume 23 number 7A pages 2711 and 2712 show a system in which drops are deflected through a plurality of angles, and the most deflected drops pass to a gutter. The surface being printed onto is angled relative to the path of undeflected drops, in such a manner that the undeflected drops have the shortest path.

One aspect of the present invention arises from the realisation by the present inventor that an advantage can be obtained by angling the active components of the print head relative to the substrate onto which the drops are printed, so as to shorten the path length of the least stable drops as compared with the path length of the most stable drops.

In the manufacture of an ink jet printer it is typically necessary to mount the active parts of the print head, including the deflection electrodes, the charge electrode and possibly one or more detection electrodes, on a mount such as a circuit board. The assembly operation can be simplified to some extent by printing some of the electrical circuits for these components on the circuit board.

In another aspect, the present invention seeks to simplify the construction of the print head of an ink jet printer by forming one or more electrodes downstream of the ink gun on or as part of the mount carrying one or more other components such as the gun and/or other electrodes.

According to a first aspect of the present invention there is provided a method of ink jet printing in which drops are deflected to be printed on a substrate and the path of the printed drop which experiences the minimum angle of deflection approaches the substrate at an angle further from right angles than the angle of approach of another drop which is printed on the substrate.

Preferably the direction of undeflected drops makes an angle with the plane of the substrate which varies from right angles by at least 10° in the plane of deflection of the drops.

According to another aspect of the present invention there is provided a longitudinally extending print head for an ink jet printer having a nozzle from which the ink jet issues, and means to deflect ink drops to a plurality of printing positions, in which the direction in which the printed drop having the least amount of deflection approaches its printing position is spaced from the direction of longitudinal extent of the print head by a greater angle than is the direction in which another printed drop approaches its printing position.

According to another aspect of the present invention there is provided a print head for an ink jet printer comprising a nozzle from which an ink jet issues and means to deflect ink drops to a plurality of printing positions, the print head having an end surface which makes an angle to the direction in which the least deflected drop approaches its printing position which is further from right angles than the angle which the end surface makes with the direction in which another, more deflected, ink drop approaches its printing position.

The angling of the end surface of the ink jet printer allows the print head to be mounted relative to the substrate to be printed onto with the desired angling of the ink drop paths while reducing the angle between the end surface of the printer and the substrate. Preferably the end surface of the printer and the substrate can be mounted to be substantially parallel. In this way the print head can be mounted close to the substrate, minimising the lengths of the flight paths of the ink drops. If the end surface of the print head is at right angles to the direction of the least deflected drops, the need to ensure that the end surface clears the substrate limits the extent to which the path of the most deflected drops can be shortened.

According to another aspect of the present invention there is provided an ink jet printer having a print head comprising a nozzle from which an ink jet issues and means to deflect ink drops to a plurality of print positions, the printer further having means for mounting the print head relative to a substrate to be printed onto so that the direction in which the least deflected drop approaches the substrate is at a greater angle to the normal than the direction from which a more deflected drop approaches the substrate.

According to a further aspect of the present invention there is provided a print head for an ink jet printer comprising a nozzle from which an ink jet issues, a plurality of electrodes downstream of the nozzle, and mounting means such as a board for mounting components of the print head, at least one of the electrodes being provided partially or wholly as a conductive layer formed on the mounting means or provided by the mounting means itself. For example, a pair of deflection electrodes may be provided such that one deflection electrode is a conductive layer formed on the mounting means or, if the mounting means is conductive, is provided by the mounting means, and the other deflection electrode is supported above the mounting means so as to be opposed to the first deflection electrode. In another example, a charge sensing electrode for detecting the presence of ink drops may be provided by a conductive pattern formed on the mounting means. A charge electrode having a gap through which the ink jet passes, and in which the ink jet breaks up into drops, so as to charge the drops, may be provided by a conductive layer formed on the mounting means over which the ink jet passes, and an electrode portion electrically connected to the conductive layer and mounted over the path of the ink jet opposing the conductive layer, so that the ink jet passes between the electrode portion and the conductive layer.

In one embodiment of this aspect of the invention the mounting means is an insulating board and at least a part of one or more electrodes is provided by a conductive layer formed on the board, for example, by conventional printed circuit board technology. In another embodiment of this aspect of the invention the mounting means is a conductive board or block, for example, of metal, and it forms one of the deflection electrodes, and is typically maintained at earth potential in use. The charge electrode is separately mounted on the mounting means insulated from it. A charge sensing electrode can be provided by an electrode portion fitted into a hole in the mounting means and insulated from it, with the mounting means providing an earth shield around the electrode portion.

By forming electrodes on or as part of the mounting means, the number of items which have to be separately mounted on it can be reduced, simplifying construction of the print head.

In a further aspect of the present invention there is provided a print head for an ink jet printer in which ink drops which are not to be printed pass to a gutter, and a substantial part of at least the path from the ink jet source to the gutter is closely adjacent a surface, e.g. no further from the surface than about 1 mm, preferably no further than about 0.5 mm. It appears that in this case, the ink passing to the gutter becomes associated with the surface such that if the surface is moved ink has a tendency to move with the surface. The reason for this is not understood, but it may result from an interaction between the jet or its associated entrained air stream with a boundary layer of air adjacent the surface.

It is believed that this association with the surface will make the jet more stable during movement of the print head, increasing the rate at which the print head can be accelerated without the jet leaving the gutter. This would allow faster operation in situations where the print head has to move between print positions.

Embodiments of the present invention, given by way of non-limiting example, will now be described with reference to the accompanying drawings, in which.

Figure 1:
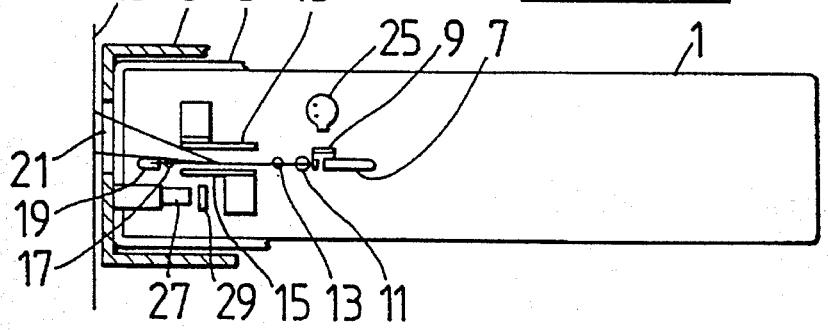
FIG.1. PRIOR ART
FIG. 1 is a plan view of the circuit board of a first prior art print head.
Figure 2:
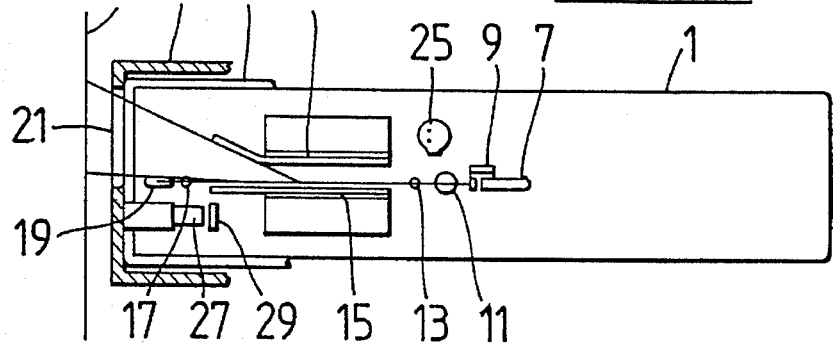
FIG.2. PRIOR ART
FIG. 2 is a view corresponding to FIG. 1 of a second prior art print head.
Figure 3:
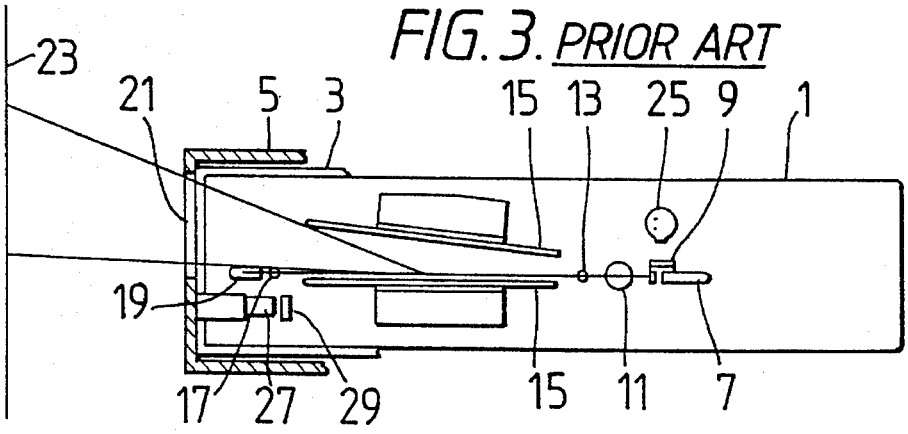
FIG. 3. PRIOR ART
FIG. 3 is a view corresponding to FIG. 1 of a third prior art print head.

FIGS. 1 to 3 are plan views showing the arrangements of print heads known from WO-A-89/03768 (U.S. patent application Ser. No. 07/469496). The active parts of each print head are mounted on a circuit board 1, which is fitted to a print head body 3. The print head body 3 is in the form of a cylinder which is cut away over most of its length along a substantially axial plane, and a circuit board 1 extends over this cutaway portion in the axial plane. The print head body 3 is fitted within a cylindrical cover 5 to protect the circuit board and the components mounted on it. In FIGS. 1 to 3 only a part of the print head body 3 and the cover 5 are shown.

In the print heads of FIGS. 1 to 3 ink is supplied to an ink gun, the main body of which is mounted beneath the circuit board 1 and which is therefore not visible in the Figures. A nozzle tube 7 extends through the circuit board 1 to a nozzle 9 shown cutaway in FIGS. 1 to 3, and the ink gun drives a jet of ink out of a jet-forming orifice in the nozzle 9.

Figure 4:
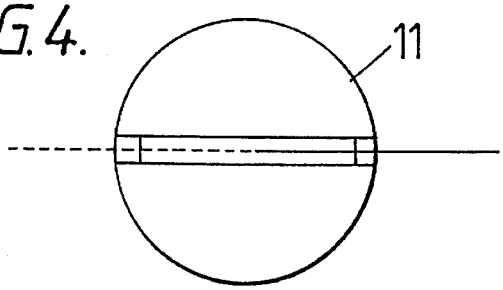
FIG. 4 is an enlarged plan view of a charge electrode as used in the print heads of FIGS. 1 to 3 and also the print heads of FIGS. 5 to 7.

The ink jet passes through a gap in a charge electrode 11, which is shown in more detail in FIG. 4. The ink gun modulates the ink jet so that it breaks into drops while it is passing through the gap in the charge electrode 11, and accordingly each drop is charged to a level determined by the voltage on the charge electrode 11 at the moment when the ink drop separates from the jet.

From the charge electrode 11 the ink jet passes over a charge sensor 13, which is operable to detect inductively charged drops passing over it. The ink jet then passes between deflection plates 15, one of which is maintained at ground and the other of which is maintained at a high voltage so as to create a deflection electric field. Charged drops of ink will be deflected by the electric field. As shown in FIGS. 1 to 3, the plane of deflection is parallel to the plane of the paper of the drawings and is parallel to the plane of the circuit board 1.

Drops which are not charged, or are charged only to a very low level, are not deflected, or are deflected only very slightly, by the electric field. Such drops pass over a time of flight detector 17, and enter a gutter 19. Ink collected by the gutter 19 is circulated back to the main ink tank of the ink jet printer. Since such drops are collected by the gutter 19, they are not used for printing. Drops having a very slight charge but still passing to the gutter can be detected inductively by the time of flight detector 17, and this is used in conjunction with the charge detector 13 to determine the time of flight of an ink drop between the two detectors, which is a measure of the jet velocity.

Drops which are charged sufficiently so as to be deflected to miss the gutter 19 pass through a slot 21 in the end surface of the print head cover 5 and pass to a substrate 23, on which they impact to create printed dots on the substrate 23.

In FIGS. 1 to 3 the paths are shown of the undeflected jet passing from the nozzle 9 to the gutter 19, the printed drop having the minimum charge necessary to be deflected so as just to miss the gutter 19 and the drop having the maximum charge so as to be deflected so as just to miss the deflection plate 15 towards which it is attracted. In practice, the charge drops will traverse a curved path through the deflection field between the deflection plates 15, but in FIGS. 1 to 3 the paths are shown as straight lines between the deflection plates 15, tracing back the final direction of the path of the deflected drop. The straight line extensions of the paths of the deflected drops join the path of the undeflected drops at a point referred to as the "focus".

The circuit board 1 also carries a temperature sensor 25, for monitoring the temperature of the print head, and a Hall effect sensor 27. The print head cover 5 carries a magnet 29 which is arranged to be closely adjacent the Hall effect sensor 27 when the cover 5 is correctly in position. In this way the Hall effect sensor 27 detects the removal of the print head cover 5. The high deflection voltage is removed from the deflection plates 15 automatically by the printer when removal of the cover 5 is sensed, as a safety precaution.

Further details of an ink jet printer having a print head as shown in FIGS. 1 to 3 are given in WO-A-89/03768.

As can be seen from FIGS. 1 to 3, undeflected drops pass in a straight line from the nozzle 9 to the gutter 19, and the direction of this line is substantially at right angles to the plane of the substrate 23 onto which the printer prints. The least deflected drop approaches the substrate 23 at an angle very close to right angles, while the most deflected drop approaches the substrate 23 at a more oblique angle, as can be seen in the Figures.

The most deflected drops tend to be the least stable, as has been explained above, and as can easily be seen in the Figures, these drops have the longest flight path.

Figure 5:
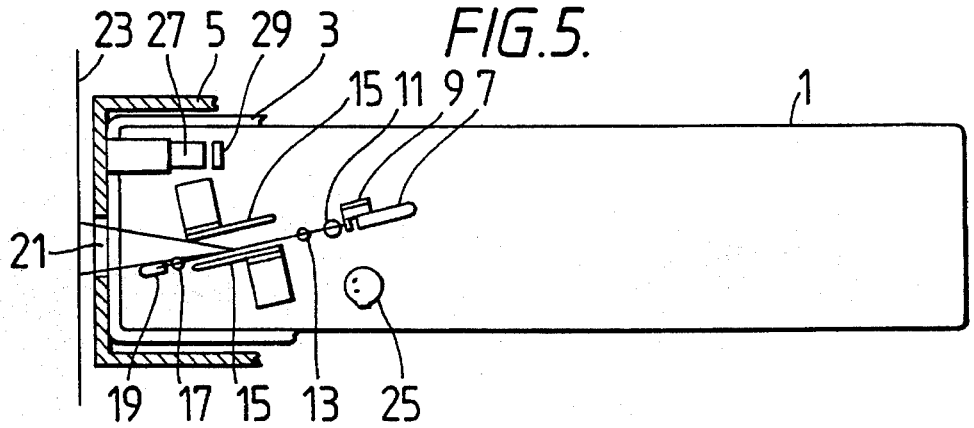
FIG. 5 is a plan view of a circuit board for a first print head according to a first embodiment of the present invention.
Figure 6:
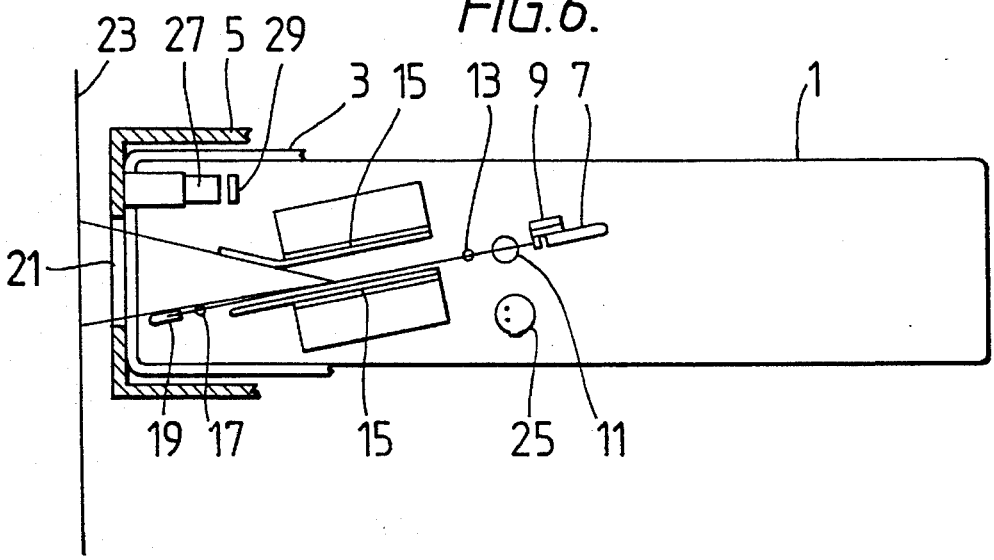
FIG. 6 is a view corresponding to FIG. 5 for a second print head according to the first embodiment.
Figure 7:
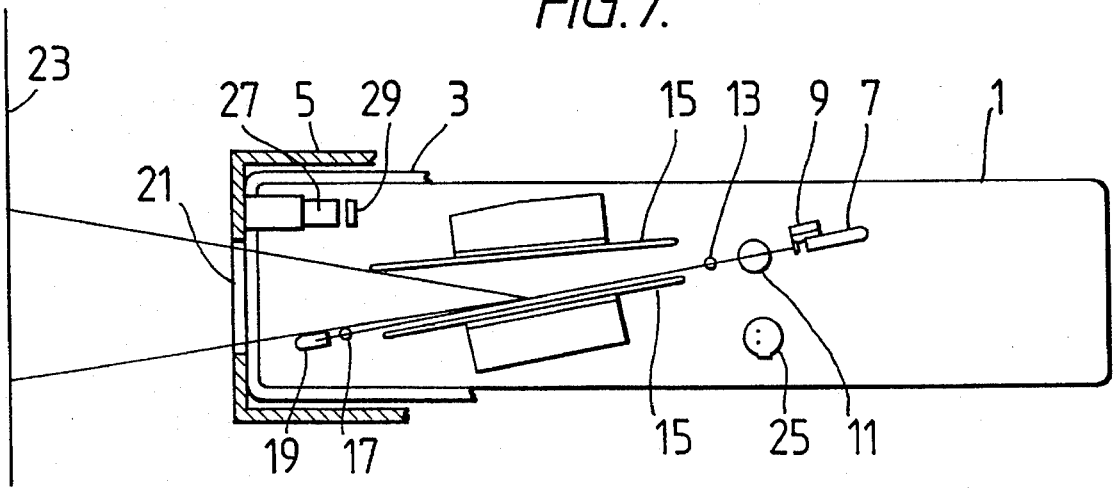
FIG. 7 is a view corresponding to FIG. 5 for a third print head according to the first embodiment.

FIGS. 5 to 7 are views corresponding to FIGS. 1 to 3, of a first embodiment of the present invention. In the print heads of FIGS. 5 to 7 the active components of the print head have been repositioned on the circuit board 1, so that the straight line path of the undeflected drops from the nozzle 9 to the gutter 19 is at about 10° from the normal to the plane of the substrate 23. As can be seen in the Figures, this has the effect of lengthening the path for the least deflected printed drops, while shortening the path for the most deflected printed drops. As a consequence of this repositioning, the temperature sensor 25, the Hall effect sensor 27 and the magnet 29 have also been repositioned and the position of the slot 21 in the end of the cover 5 is repositioned to correspond to the new paths for the printed drops.

The shortening of the path of the most deflected drops reduces the error in the printing position of such a drop for any given error in the direction of its path. Accordingly, the same print quality can be obtained as with the prior art print heads of FIGS. 1 to 3 with a reduction in the number of guard drops. This enables faster printing. Alternatively, the number of guard drops can be maintained and higher print quality can be obtained.

The optimum angle to be made between the direction of undeflected drops and the plane of the substrate 23 will depend on the precise nature of the ink jet printer concerned, and particularly on the geometry and other features of construction of the print head. If the angle becomes very oblique, the print quality of the most deflected drops may become better than the print quality of the least deflected-drops, in which case moving the angle further away from the normal is likely to be detrimental rather than beneficial. Additionally, a very oblique angle of incidence of the drops on the substrate may lead to each drop printing as an elongate or streaked dot instead of a generally circular dot. However, it is expected that in most cases it will be beneficial to vary the angle at least to the point where the least deflected drops have the same path length as the most deflected drops. Since the most deflected drops tend to be least stable, as referred to above, it is expected that in many cases the optimum angle will be somewhat beyond this point, so that the path of the most deflected drops is shorter than the path of the least deflected drops. It may even be advantageous to make the path of the most deflected drops the shortest. In any particular case, it may be necessary to perform experiments with various angles of the substrate 23 to determine the optimum angle. Such experiments will be within the competence of those of ordinary skill in the art.

The construction and operation of the print heads of FIGS. 5 to 7 and the ink jet printer incorporating any of those heads will be substantially as described in WO-A-89/03768 having the modification proposed in EP-A-0424008, except for the differences already noted, and reference is made to those documents for a detailed explanation. A brief explanation will now be given with reference to FIGS. 8 to 13. However, it should be noted that the change in path length of the printed drops and in the angle at which they strike the substrate 23 means that different levels of charge will be needed to maintain evenly spaced printing positions for the drops on the substrate 23. One consequence of this change in the charge levels will be discussed later.

Figure 8:
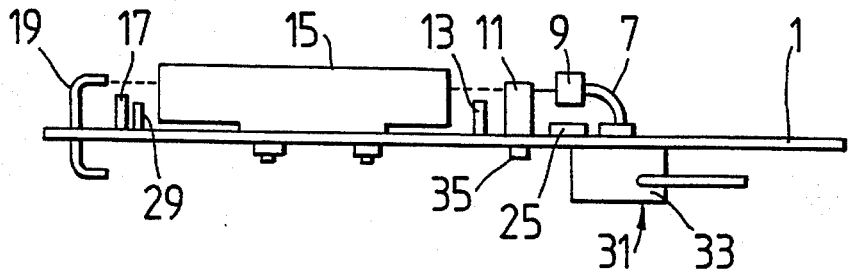
FIG. 8 is a side view of a circuit board of FIG. 7.

FIG. 8 shows a side view of the circuit board 1 and the parts mounted on it, for the print head of FIG. 7 or the prior art print head of FIG. 3. In this Figure substantially the whole of the ink gun 31 can be seen, and in particular the ink gun body 33 is shown below the circuit board 1. In addition to the components shown in FIGS. 1 to 7, FIG. 8 also shows a light emitting diode 35 mounted below the charge electrode 11. The light emitting diode 35 can be seen through the gap in the charge electrode 11 and this is used to enable the position of the jet in the gap to be seen. Electrical and liquid connections to the components of the print head are not shown in FIG. 8, for clarity.

Figure 9:
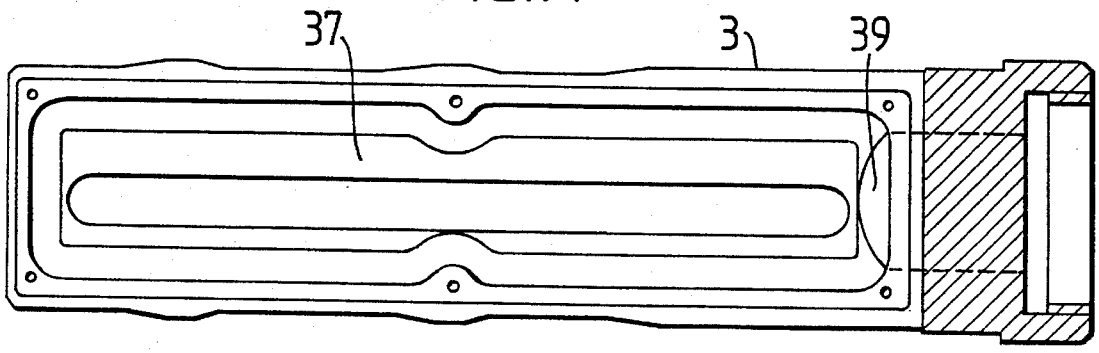
FIG. 9 is a section through the body of a print head in the plane of the circuit board.
Figure 10:
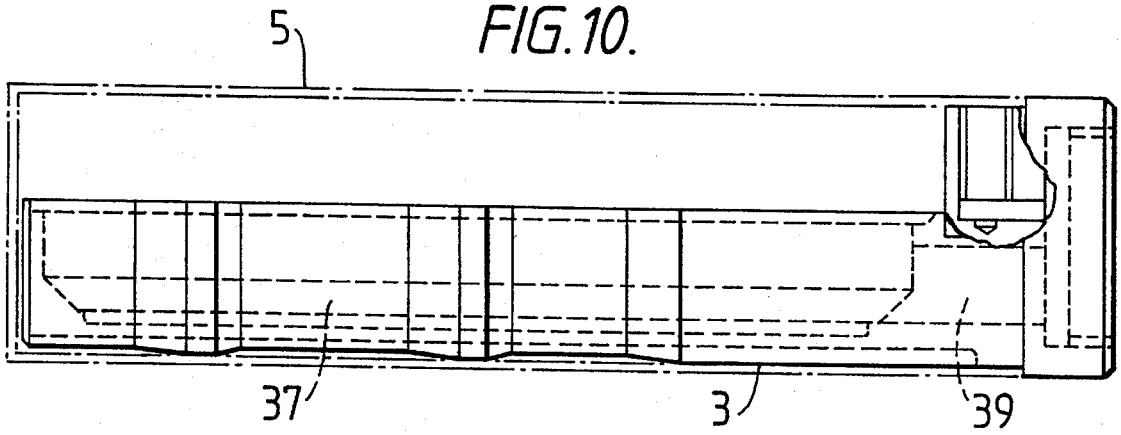
FIG. 10 is a side view of the body of a print head.

FIG. 9 is a section through the print head body 3 in the plane of the mounting circuit board 1. FIG. 10 is a side view of the print head body 3, showing the print head cover 5 in dotted lines. In FIG. 10 part of the print head body 3 is cut away to show a threaded hole which receives a screw, which is located in a slot of the print head cover 5 so as to keep the print head cover 5 in the correct orientation around the cylindrical axis of the print head body 3.

The inside of the print head body 3 is hollowed out so as to leave a space 37 below the circuit board 1, for accommodating the liquid and electrical connections, and a bore 39 connects the space 37 to the end of the print head body 3 remote from the substrate 23 in use, enabling the liquid and electrical connections to pass out of the print head body 3 and into a flexible conduit which carries them to the main body of the ink jet printer.

Figure 11:
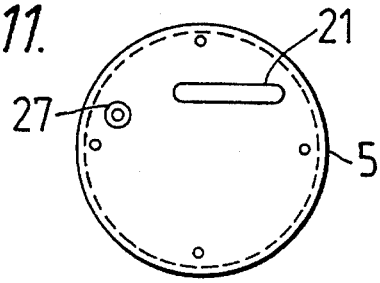
FIG. 11 is an end view of the cover of a print head.

FIG. 11 is an end view of the print head cover 5, showing the slot 21 and the mounting for the magnet 29.

Figure 12:
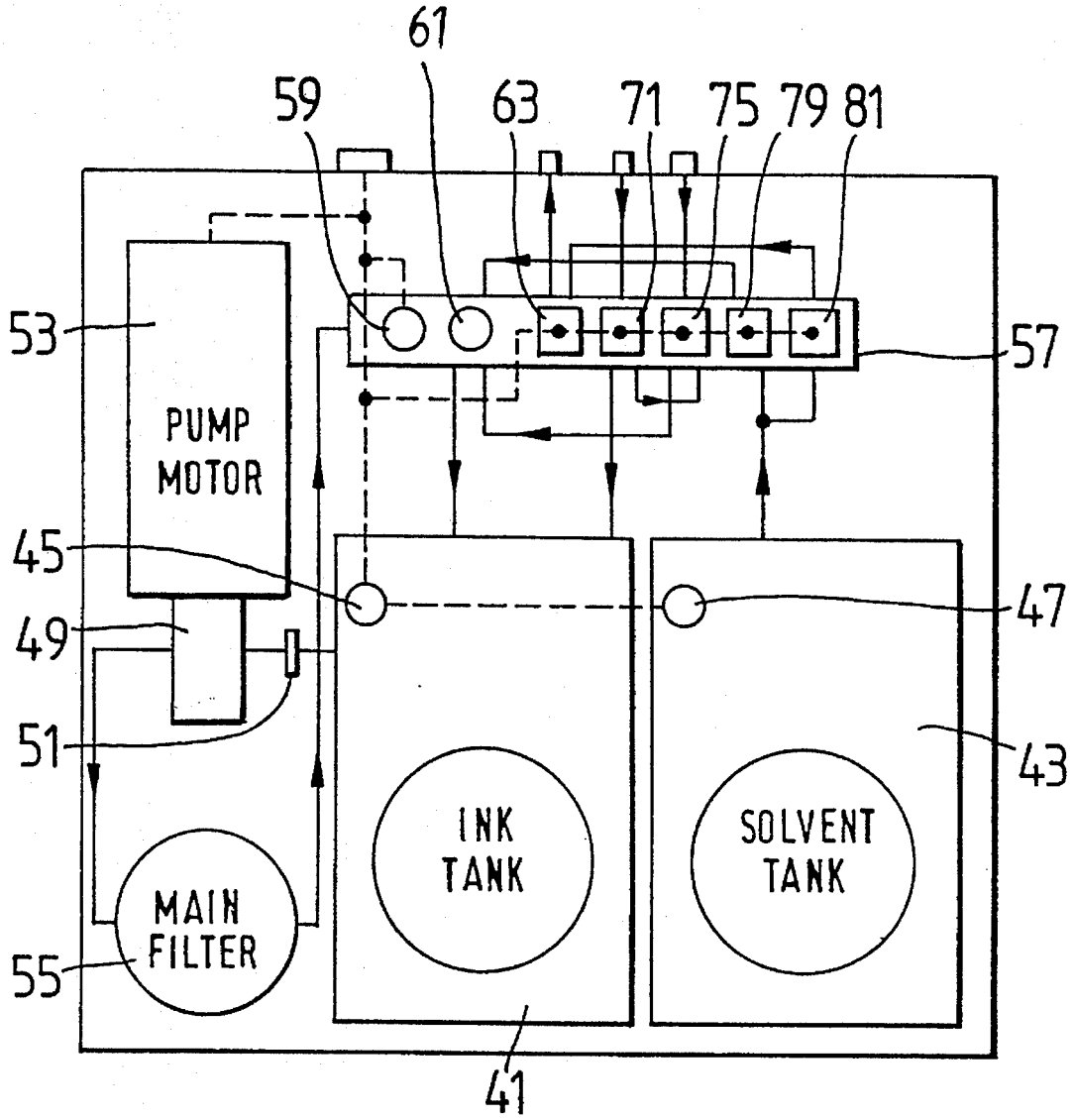
FIG. 12 is a diagram showing some of the liquid and electrical connections within the main body of an ink jet printer.
Figure 13:
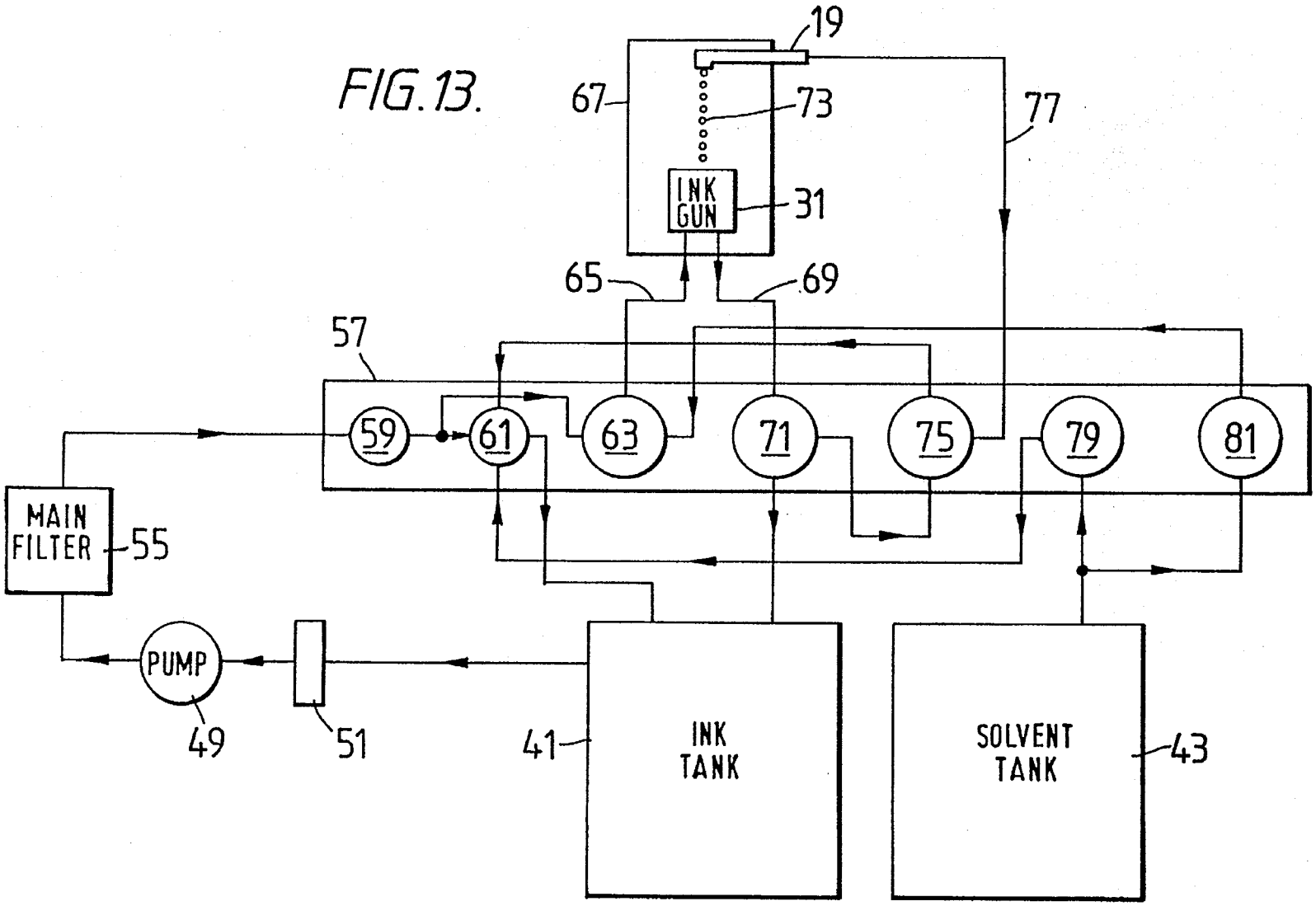
FIG. 13 is a diagram of the liquid paths of an ink jet printer.
Figure 14:
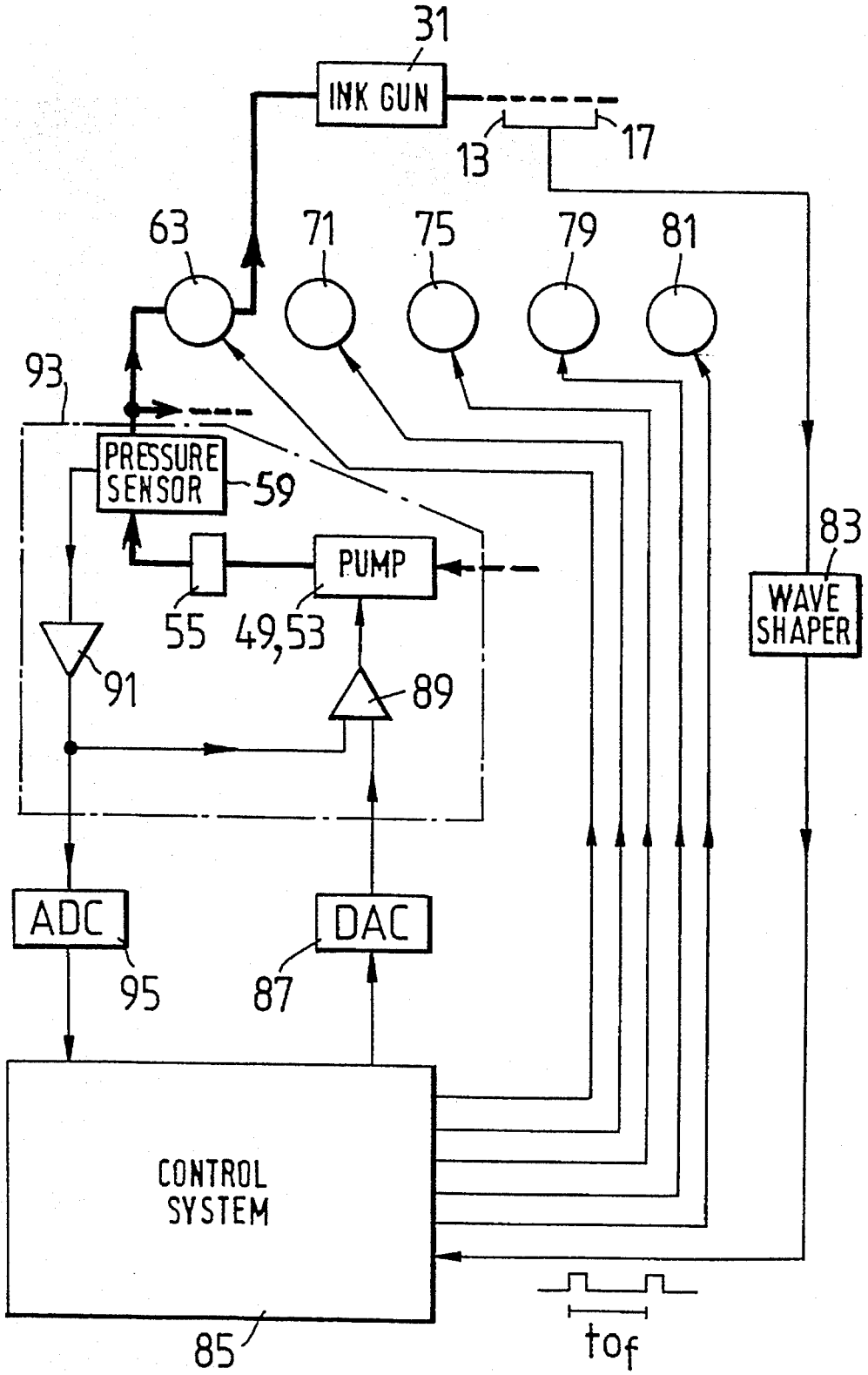
FIG. 14 is a diagram of the arrangements for controlling the ink pressure and viscosity and the valves in an ink jet printer.

FIG. 12 shows schematically the liquid flow paths and electrical control paths in the main body of the ink jet printer. In this Figure, the liquid flow paths are shown in solid lines and the electrical connections are shown in broken lines. FIG. 13 shows the complete liquid circuit arrangement of the printer including the print head. FIG. 14 shows a part of the liquid flow paths together with the electrical control system for the ink pressure and viscosity and the controls for the valves in more detail than is shown in FIG. 12. In FIG. 14 liquid paths are shown in a heavy line and electrical connections are shown in lighter lines.

With reference to FIGS. 12 and 13, the ink jet printer body houses an ink tank 41 and a solvent tank 43. The tanks have respective level sensors 45,47 to detect when the level of ink or solvent is getting low.

Ink from the ink tank 41 passes to a pump 49 via pre-filter 51 which protects the pump from solid particles in the ink. The pump 49 is driven by a motor 53 under the control of the ink pressure control system to be described later. From the pump 49 the ink passes through a main filter 55 to a valve block 57. In the valve block the pressure of the ink is detected by a pressure sensor 59 and then can pass along two alternative paths one of which leads to a suction source 61. The ink flowing through the suction source 61 is used to generate suction using the Bernouilli effect. From the suction source 61 the ink returns to the ink tank 41. The ink path through the suction source 61 is a complete loop, containing no valves. Accordingly, it provides a path by which pressurised ink may leave the pump 49 even if other paths are closed by valves, and it ensures that the suction source 61 provides suction for as long as the pump 49 is operating.

From the pressure sensor 59 ink may also pass to a feed valve 63, bypassing the suction source 61. The feed valve 63 is switchable to block the path of the ink or alternatively to connect it to a feed line 65 which carries the ink through the conduit to the ink gun 31 in the print head (shown schematically at 67 in FIG. 13).

Pressurised ink in the ink gun 31 forms the ink jet, and ink not forming the jet returns through a purge line 69 and a purge valve 71 to the ink tank 41.

Undeflected ink drops 73 pass to the gutter 19. Suction from the suction source 61 is normally applied through a gutter valve 75 to a gutter line 77 connected to the gutter 19. Accordingly, the gutter 19 is put under suction and ink passes from it along the gutter line 77 and through the gutter valve 75 and a suction source 61 to return to the ink tank 41.

In order to apply suction to the ink in the ink gun 31, for example to purge it, the gutter valve 75 may be switched to apply suction from the suction source to the purge valve 71, and the purge valve 71 may be switched to pass the suction to the purge line 69.

Suction from the suction source 61 is also applied to the solvent tank 43 through a top up valve 79. The top up valve 79 is opened to permit solvent to be sucked into the suction source 61 and thereby passed to the ink tank 41 to dilute the ink, in order to maintain the desired ink viscosity.

As is described in EP-A-0424008, the solvent tank 43 is also connected through a flush valve 81 to the feed valve 63. Accordingly, the solvent tank 43 may be connected through the flush valve 81 and the feed valve 63 to the feed line 63. If at the same time the purge valve 71 and the gutter valve 75 are switched to apply suction to the ink gun 31 through the purge line 69, solvent can be sucked from the solvent tank 43 into the ink feed line 65. This may be done as part of a routine of flushing the ink gun 31.

Turning to FIG. 14, slightly charged drops from the ink gun 31 can be detected by the charge detector 13 and time of flight detector 17, and the outputs of these detectors are wired together and passed through a wave shaper 83 to the control system 85. The time interval between the output pulses from the two detectors 13,17 is a measure of the time of flight of the ink drops and hence of the ink jet velocity.

In response to the detected ink jet velocity the control system 85 outputs a pressure control number which is converted by a DAC 87 to an analogue signal which controls the pump 49 through a differential amplifier 89. The output signal from the pressure sensor 59 is amplified in an amplifier 91, to provide the other input to the differential amplifier 89, thereby closing a feed back loop (provided by the components in chain dotted line 93) which controls the pump to provide the pressure specified by the number output from the control system 85 to the DAC 87. The detected pressure signal from the amplifier 91 is also converted to a digital value in an ADC 95, and input to the control system 85.

If the pump pressure required to maintain the desired value for time of flight exceeds a preset limit, it is concluded that the ink viscosity is too high, and the control system 85 activates the top up valve 79 to add a quantity of solvent to the ink tank 41 to reduce the ink viscosity.

The control system 85 also controls the voltage of the charge electrode 11 and the modulation signal to the ink gun 31, through electrical connections not shown in the drawings, in a manner known from WO-A-89/03768 (and U.S. Ser. No. 07/469496).

Figure 15:
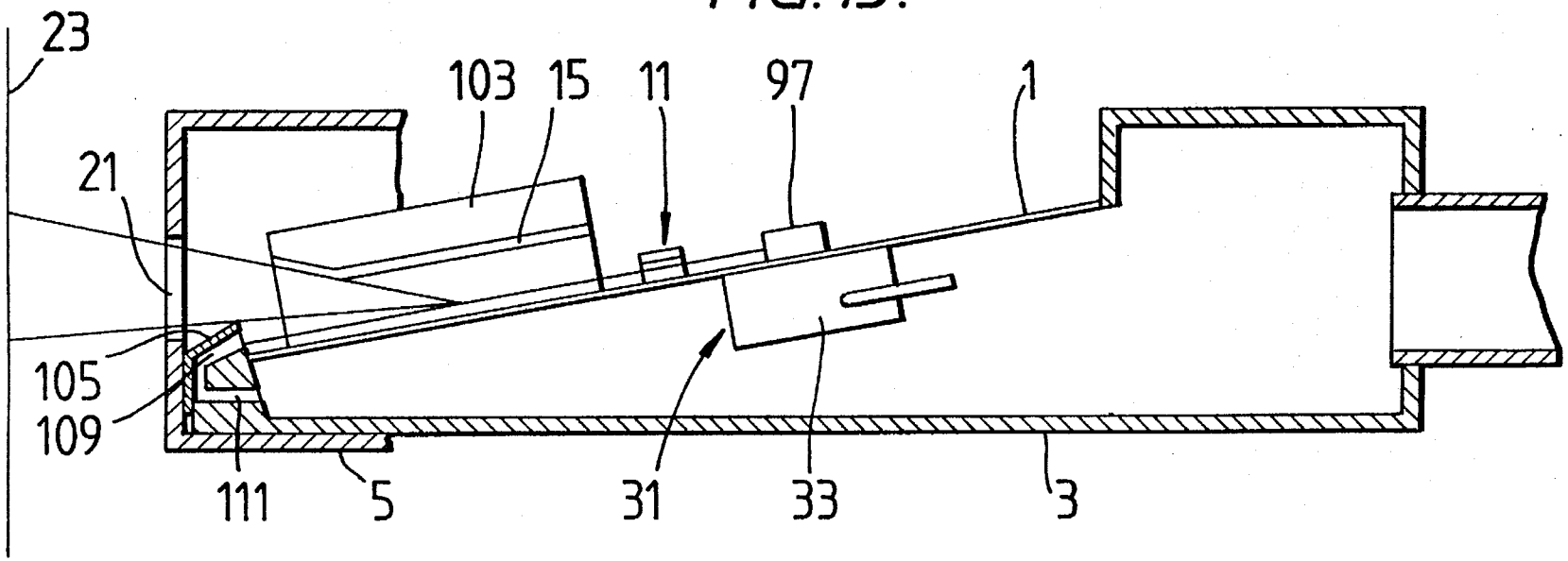
FIG. 15 is a schematic sectional side view of a print head according to a second embodiment of the present invention.
Figure 16:
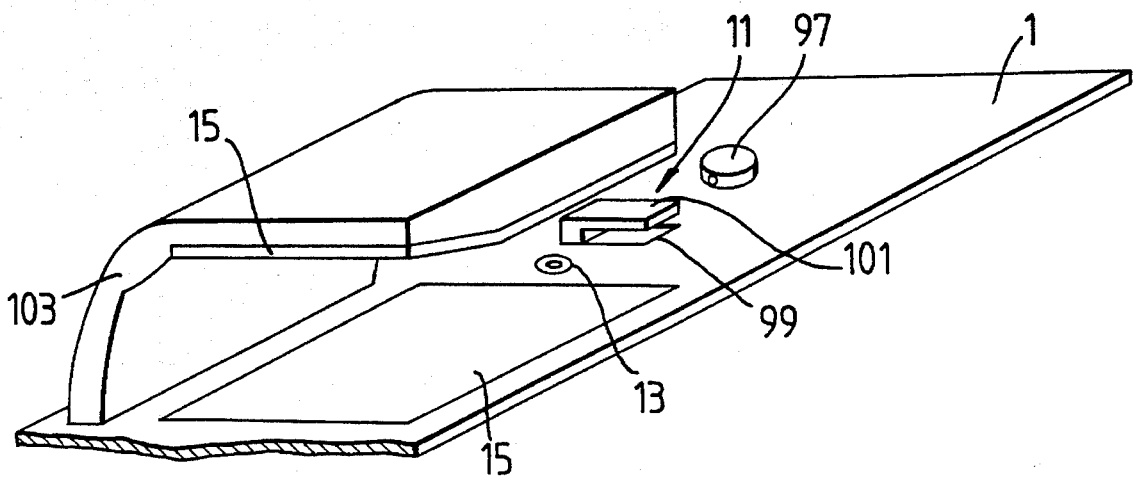
FIG. 16 is an isometric view of part of the circuit board of FIG. 15.

FIG. 15 shows a schematic side view of a print head according to a second embodiment of the present invention, and FIG. 16 is a schematic isometric view of part of the circuit board 1 of the embodiment of FIG. 15. In FIG. 15 the print head body 3 is shown in longitudinal section, and part of the print head cover 5 is also shown in longitudinal section. The temperature sensor 25, Hall effect sensor 27 and the magnet 29 are not shown in the these drawings, for reasons of clarity, and similarly the liquid and electrical connections are not shown.

In the embodiment of FIGS. 15 and 16 the plane of deflection has been rotated by 90°, so as to be at right angles to the plane of the circuit board. Accordingly, the active components of the print head are mounted straight along the length of the circuit board 1 in the manner shown in FIGS. 1 to 3, rather than being angled as in FIGS. 5 to 7, but the circuit board 1 itself is mounted in the print head body 3 with a tilt, so that the line of undeflected drops passing from the nozzle 9 to the gutter 19 is not normal to the plane of the substrate 23, thereby shortening the path of the most deflected drops.

The details of the operation of this print head are substantially the same as for the print heads already described, and accordingly this description will not be repeated.

The embodiment of FIGS. 15 and 16 has some constructional advantages over the print head arrangements previously described. The ink gun 31 is arranged so that the nozzle tube 7 and the nozzle 9 are provided within a cap 97 and protrude less far above the ink gun body 33 and the circuit board 1 than in the previous arrangements. Accordingly, the undeflected ink jet travels over the circuit board 1 with a smaller spacing, for example about 0.5 mm to 1 mm.

This small spacing between the jet and the circuit board 1 appears to make the jet more stable and resistant to disturbance by air currents and movements of the print head. The entire path of the jet to the gutter is at this close spacing to the circuit board 1, and accordingly it appears that the head can be moved more sharply while the jet runs to the gutter than would be possible if the jet was not close to any surface. The critical factor when moving the print head with the jet running is normally that acceleration and deceleration should not cause the jet to fail to enter the gutter. If the maximum acceleration and deceleration can be increased, the head can be moved more quickly from one position to another, speeding up printing in cases where such movement is required.

The charge electrode 11 is formed by a first portion 99 printed or plated directly onto the circuit board 1, and a second portion 101 which is mounted on the circuit board 1 to extend over the first portion 99. The slot in the charge electrode through which the ink jet passes is provided between the facing surfaces of the first portion 99 and the second portion 101, and extends horizontally rather than vertically as in the previous arrangements. As can be seen in FIG. 16, the second portion 101 of the charge electrode is L-shaped, with a horizontal arm extending over the first portion 99 and a vertical arm extending down to be mounted on the circuit board 1. A light emitting diode is provided in the vertical arm to be visible to someone looking into the slot of the charge electrode from the side of the print head, to assist in viewing the ink jet.

As can be seen in FIG. 16, the charge detector 13 is provided entirely by plated or printed metal films. The time of flight detector 17, which is not shown in FIG. 16, is provided in the same way. One of the deflection plates 15 is also provided as a printed or plated conductive film, while the second is supported over it by an insulating support 103.

The use of conductive layers or films formed directly on the circuit board 1 reduces the number of components which need to be mounted on the board. In the embodiment of FIGS. 15 and 16 it is only necessary to mount one of the deflection plates instead of both and there is no need to mount the charge detector or the time of flight detector. This simplifies assembly by reducing the number of mounting operations, and also makes it easier to position the components concerned accurately. Additionally, in the case that the jet runs very close to the circuit board 1, the conductive layers or films provide a convenient way of forming very thin electrodes which will not obstruct the jet path. The conductive layers or films can be formed by any conventional printing, plating or other technique, and are conveniently formed using conventional techniques for forming printed circuits.

As can be seen in FIG. 15, the gutter 19 is provided by a different construction in this embodiment from the tube or pipe shown in FIGS. 1 to 3 and 5 to 7. In the present embodiment, a thickened end portion of the print head body 3 extends past the downstream end of the circuit board 1, to a height greater than that of the path of undeflected drops. At the path of the undeflected drops a slot 109 is cut in the print head body 3 to receive the undeflected drops and act as the gutter. The slot 109 is closed by a plate 105 attached to the print head body 3, and a bore 111 connects the slot 109 to the space below the circuit board 1. The slot 109 and the bore 111 jointly form the gutter 19, and the gutter line 77 may be connected to the bore 111 in any convenient manner.

This arrangement facilitates manufacture and prevents attempts by operators to alter the position of the gutter.

As will be apparent to those skilled in the art, the arrangement of the plane of deflection of the drops normal to the plane of the circuit board 1 instead of parallel to it, and the use of conductive layers formed on the circuit board 1 for one or more of the electrode portions of the print head assembly, can be used equally in print heads in which the line of undeflected drops passing through the gutter is normal to the substrate 23 and parallel to the longitudinal axis of the print head, and the same constructional advantages may be obtained also in this case.

Figure 18:
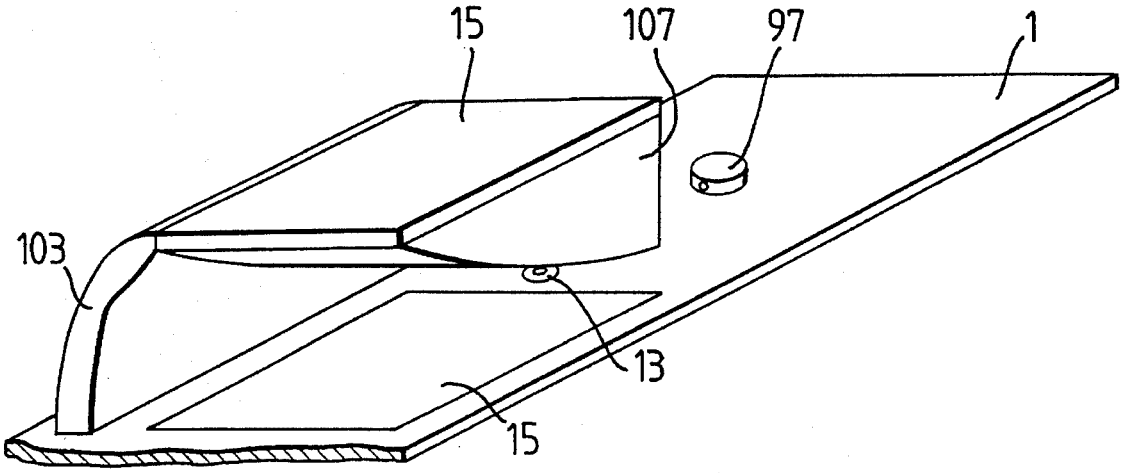
FIG. 18 is a view corresponding to FIG. 16 of part of a circuit board of FIG. 17.
Figure 17:
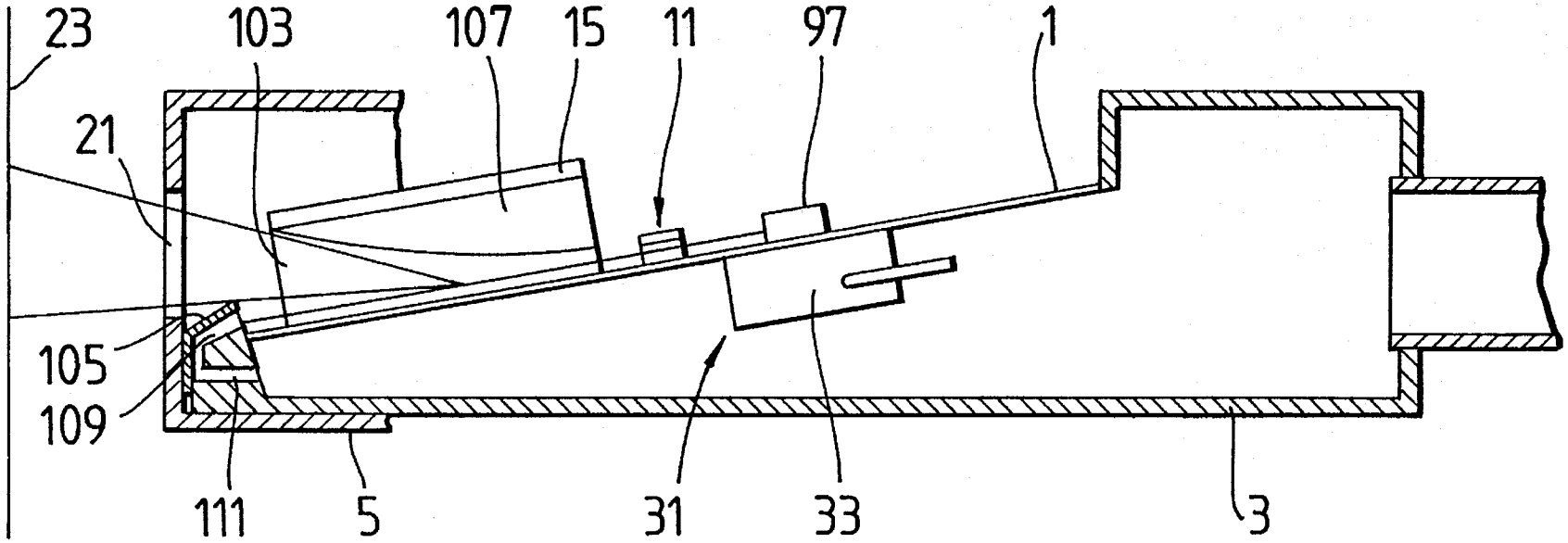
FIG. 17 is a view corresponding to FIG. 15 of a print head according to a third embodiment of the present invention.

FIGS. 17 and 18 are views of a print head according to a third embodiment of the present invention, corresponding to the views of FIGS. 15 and 16. In the embodiment of FIGS. 17 and 18 the deflection plate 15 mounted on the insulating support 103 carries a wedge 107 of dielectric material on its side facing the ink jet and the other deflection plate 15. The theory and advantages of this arrangement are discussed in GB patent application 9025273.5. Briefly, the strength of the breakdown electric field across an air gap varies with the width of the gap, it being possible to sustain a greater field across a narrower gap. The dielectric material for the wedge 107 is chosen so that the potential difference between the two deflection plates 15 creates a stronger field in the air gap than in the wedge 107. The varying width of the wedge 107 varies the strength of the field in the air gap, so that where the wedge 107 is wide and the air gap is narrow, the field across the air gap is stronger. In this way, the higher breakdown field of a narrow air gap is used to provide a greater initial deflection field for the ink drops as they enter the space between the deflection plates 15. The air gap has to become wider in the direction of flight of the ink drops, in order to accommodate the path of the most deflected drops, and the consequent thinning of the dielectric wedge 107 causes a corresponding reduction in the field strength across the air gap, so as to avoid exceeding the reduced breakdown field strength of the wider gap.

Apart from the difference in the arrangement of the deflection plates 15 discussed above, the embodiment of FIGS. 17 and 18 is the same as the embodiment of FIGS. 15 and 16.

Figure 19:
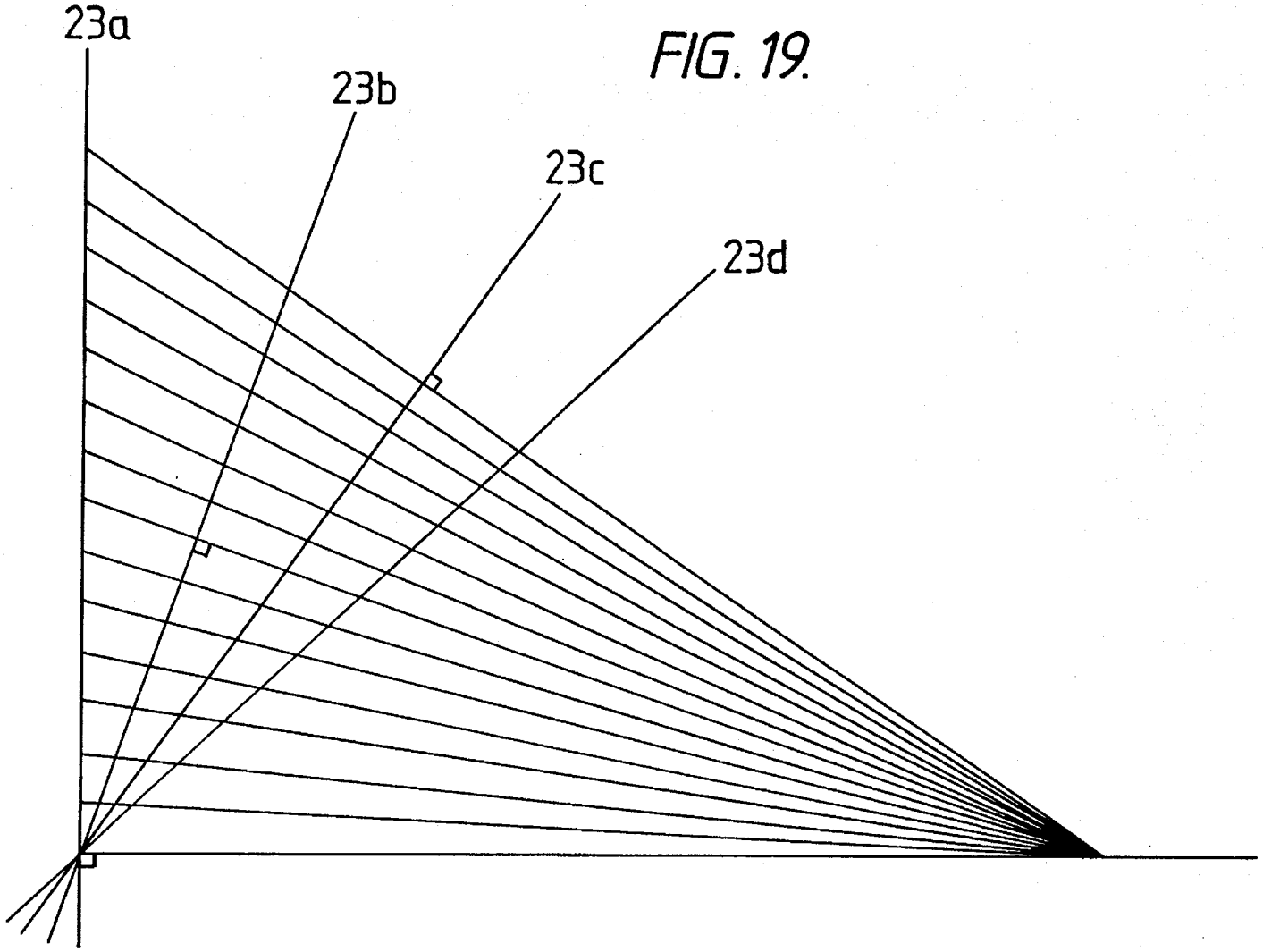
FIG. 19 is a diagram of ink drop flight paths showing the effect of altering the angle between the flight paths and the substrate which is printed onto.

FIG. 19 is a diagram of the theoretical straight line flight paths of ink drops from the focus of deflection to the substrate 23. As has previously been mentioned, the real paths will be curved in the region between the deflection plates 15. In the diagram of FIG. 19, the path of undeflected drops shown at the bottom of the diagram is at right angles to the plane of the substrate to be printed onto in a first orientation **23*a*. A second orientation 23*b* for the substrate is at right angles to the path of the drop halfway between the path of the most deflected drops and the path of the undeflected drops. A third orientation 23*c* is at right angles to the path of the most deflected drops. It is clearly visible from FIG. 19 that, for an unchanged length for the path of the undeflected drops, the path of the most deflected drops is substantially shorter for orientation 23*b* than for orientation 23*a*, and is shortened yet further for orientation 23*c***.

The paths illustrated in FIG. 19 are arranged so that the drops passing along the different paths print at equally spaced positions along the substrate 23 in orientation **23*a*. If the spacing between the print positions of the drops for orientation 23*c* is considered, it can easily be seen that the spacing is uneven, and the spacing between relatively slightly deflected drops is much greater than the spacing between relatively greatly deflected drops. Accordingly, if an even spacing between drop print positions is to be provided for the substrate orientation 23*c*, the difference in deflection angle between adjacent paths must be increased for the relatively greatly deflected drops, by increasing the difference between the levels to which drops for adjacent print positions are charged. Consequently, the voltage difference between the voltages for the charge electrode 11** for adjacent print positions will be increased for the relatively greatly deflected drops.

This increase in the voltage change required to switch from one drop path to another, or the reduction in the amount by which the print position changes for a given change in charge electrode voltage, is advantageous.

The most deflected drops leave the air stream entrained by the path to the gutter most quickly, and therefore experience most aerodynamic drag. This slows them down, so that they spend more time in the deflection field. This increased time in the deflection field magnifies the effect of any error in the amount of charge on the drop. Such charge errors may result from the resolution with the control system 85 provides the voltage for the charge electrode 11. For example, if the control system 85 provides the correct voltage to the nearest volt, the voltage actually provided may differ from the precise correct voltage by up to 0.5 volts in either direction.

Angling the substrate 23 away from orientation **23*a* towards orientation 23*c*** increases the change in position at which a drop hits the substrate for a given change in voltage for the least deflected drops, and reduces the change in position for a given change in voltage for the most deflected drops. Thus the positional errors resulting from incorrect charging, e.g. owing to limited resolution of the charge electrode voltage, are reduced for most deflected drops, which would otherwise be most strongly affected by charging errors.

The advantage, that the voltage change required to switch between adjacent paths is increased for relatively highly charged drops, is only a consequence of altering the angle of the substrate 23, and is not a consequence of shortening the flight path for the most deflected drops. Shortening the flight path has the advantage of reducing the print position error owing to instability in flight (e.g. due to mutual repulsion between successive drops) for the least stable drops. The optimum angle for the substrate may be different for the different advantages, and in that case a compromise angle will have to be adopted. In some circumstances an orientation **23*d* may be useful in which even the shortest path, for the most deflected drops, does not approach the substrate 23** at right angles.

Precise values of the voltages for the charge electrode 11 and the deflection plates 15, and the positioning and velocity of ink jet will vary with the precise size and geometry of the print head, and also interact with each other, as will be well understood by those skilled in the art. There is considerable variation even between nominally identical print heads, as the precise position of the ink jet in the gap of the charge electrode 11 affects its capacitive coupling with the charge electrode 11, and hence the amount of charge induced on a drop for any given voltage on the charge electrode 11. For these reasons, it is not possible to prescribe the voltage and velocity parameters to be used with the illustrated print heads. However, those skilled in the art will be familiar with the routines by which suitable values are determined in any individual case. As approximate values for the illustrated embodiments, jet velocity will generally be in the range of 10 to 30 meters per second, typically in the range of 15 to 20 meters per second. The maximum charge electrode voltage may be several hundred volts, e.g. in the range 250 V to 300 V. Considerable variation is possible, but the voltage normally has to be switched very quickly and it may be difficult or expensive to provide circuitry capable of switching higher voltages at the required speed. The deflection electrodes will typically have a potential difference between them of the order of 10 kV. This also may vary considerably, but a safety margin should be maintained in any fields associated with these electrodes relative to the breakdown field strength of air.

Illustrative embodiments of the present invention have been described. Modifications and alternatives will be apparent to those skilled in the art.

I claim:

1. A method of ink jet printing comprising the steps of:

conveying a plurality of articles past a print head of an ink jet printer by a conveying means, the articles having surfaces to be printed onto;

generating at said print head a plurality of drops of ink moving in a direction of travel; and generating a deflection field to deflect at least some of said drops through a plurality of deflection angles to a plurality of print positions on said surfaces, the deflection field having a field direction generally at right angles to the direction of travel of undeflected drops, and the direction in which the least deflected drops approach the surfaces being further from the normal to the surfaces than the direction from which another, more deflected, drop approaches the surfaces.

2. A method according to claim 1 in which the least deflected drops approach the surfaces at an angle at least 10° to the normal.

3. A method according to claim 1 in which the angle between the direction of approach to the surfaces of the least deflected drops and the normal to the surfaces is at least as great as the angle between the direction of approach to the surfaces of the most deflected drops and the normal to the surfaces.

4. A method according to claim 1 in which the most deflected drops approach the surfaces substantially normally.

5. A method according to claim 1 in which most deflected drops approach the surfaces at an angle closer to the normal to the surfaces than the angle at which any other drops approach the surfaces.

6. A method according to claim 1 in which undeflected drops are not printed but are caught by a gutter.

7. A longitudinally extending print head for an ink jet printer for printing onto a plurality of articles conveyed past the print head by a conveying means, comprising a source of an ink jet and means to provide a deflection field with a field direction generally at right angles to the direction of travel of undeflected drops so as to deflect drops of ink from the ink jet through a plurality of deflection angles into a plurality of paths to be printed, the angle between the longitudinal direction of the print head and the direction in which the jet leaves the source being greater than the angle between the longitudinal direction of the print head and the direction of one of the paths into which the drops are deflected.

8. A print head according to claim 7 in which the jet leaves the source in a direction which makes an angle of at least 10° to the direction of longitudinal extent of the print head.

9. A print head according to claim 7 in which the angle between the longitudinal direction of the print head and the direction in which the jet leaves the source is at least as great as the angle between the longitudinal direction of the print head and the direction of the path into which the most deflected drop is deflected.

10. A print head according to claim 7 in which the direction of the path into which the most deflected drops are deflected is substantially parallel to the longitudinal direction of the print head.

11. A print head according to claim 7 in which the direction of the path into which the most deflected drops are deflected is at a smaller angle to the longitudinal direction of the print head than is the path into which any other drop is deflected.

12. A print head according to claim 7 comprising a gutter positioned to catch undeflected drops.

13. A print head for an ink jet printer for printing onto a plurality of articles conveyed past the print head by a conveying means., said print head comprising a source of an ink jet and means to provide a deflection field with a field direction generally at right angles to the direction of travel of undeflected drops so as to deflect drops from the jet through a plurality of deflection angles into a plurality of paths to be printed, the end of the print head downstream with respect to the ink jet making an angle with the direction in which the jet leaves the source which is further from right angles than the angle between the end and the direction of one of the said paths.

* * * * *

UNITED STATES PATENT AND TRADEMARK OFFICE

CERTIFICATE OF CORRECTION

PATENT NO. : 5,455,614

DATED : Oct. 3, 1995

INVENTOR(S) : Rhodes

It is certified that error appears in the above-indentified patent and that said Letters Patent is hereby corrected as shown below:

Cover page, item [54], "PRINTING" should read —INK JET PRINTING—
Column 14, line 46, "means.," should read —means,—

Signed and Sealed this

Twenty-third Day of April, 1996

*Attest:*

*Attesting Officer*

BRUCE LEHMAN

*Commissioner of Patents and Trademarks*